US009491975B2

(12) United States Patent
Lintel

(10) Patent No.: US 9,491,975 B2
(45) Date of Patent: Nov. 15, 2016

(54) GARMENTS FOR FEMALE PATIENTS

(76) Inventor: Cynthia L. Lintel, Staatsburg, NY (US)

( * ) Notice: Subject to any disclaimer, the term of this patent is extended or adjusted under 35 U.S.C. 154(b) by 883 days.

(21) Appl. No.: 13/209,162

(22) Filed: Aug. 12, 2011

(65) Prior Publication Data

US 2012/0042435 A1 Feb. 23, 2012

Related U.S. Application Data

(60) Provisional application No. 61/374,802, filed on Aug. 18, 2010.

(51) Int. Cl.

| | |
|---|---|
| ***A41B 9/00*** | (2006.01) |
| ***A41D 1/20*** | (2006.01) |
| *A41D 13/12* | (2006.01) |

(52) U.S. Cl.

CPC ..... *A41D 1/205* (2013.01); *A41D 13/129* (2013.01); *A41D 13/1245* (2013.01)

(58) Field of Classification Search

USPC ..... 2/48, 69.5, 74, 104–106, 114, 227, 311
See application file for complete search history.

(56) References Cited

U.S. PATENT DOCUMENTS

| | | | | |
|---|---|---|---|---|
| 3,052,799 | A * | 9/1962 | Hollands | 250/516.1 |
| 3,464,063 | A * | 9/1969 | Hoegerman | 2/114 |
| 5,050,242 | A * | 9/1991 | Udell | 2/114 |
| 6,134,715 | A * | 10/2000 | McLennan | 2/114 |
| 7,395,556 | B2 * | 7/2008 | Eraca | 2/104 |
| 2008/0000006 | A1 * | 1/2008 | Ochoa et al. | 2/114 |
| 2009/0094729 | A1 * | 4/2009 | Lin et al. | 2/114 |
| 2010/0313330 | A1 * | 12/2010 | Sampson-Howlett | 2/114 |
| 2011/0131701 | A1 * | 6/2011 | Pryne et al. | 2/114 |
| 2011/0231981 | A1 * | 9/2011 | Appel et al. | 2/114 |

* cited by examiner

*Primary Examiner* — Nathan Durham
*Assistant Examiner* — Sally Haden
(74) *Attorney, Agent, or Firm* — Law Offices of Michael L. Wise, LLC

(57) ABSTRACT

A garment is adapted for use by female patients. A frontal portion of the garment covers at least a portion of the frontal trunk and frontal lower limbs of the female patient when the garment is worn. A left rear portion, in turn, is attached to a leftmost edge of the frontal portion and covers at least a portion of the rear trunk and rear lower limbs of the female patient. A right rear portion is attached to a rightmost edge of the frontal portion and overlaps the left rear portion. In order to secure the garment, a left belt attached to a leftmost edge of the left rear portion passes through a belt hole located proximate to the interface of the frontal portion and the right rear portion as well as a right belt loop, while a right belt attached to a rightmost edge of the right rear portion passes through a left belt loop.

12 Claims, 3 Drawing Sheets

GARMENTS FOR FEMALE PATIENTS

FIELD OF THE INVENTION

The present invention relates generally to clothing, and, more particularly, to garments for use by female patients receiving medical treatment.

BACKGROUND OF THE INVENTION

Many hospitals recognize that the act of giving birth is an extremely special and important experience for the new mother and her family. As a result, these hospitals have endeavored to set up maternity wards designed to give the mother and her family a nurturing and homey environment that is far removed from the drab and sterile functionality of typical hospital surroundings. These maternity wards may be referred to as "birth centers" or "birthing centers" to further remove them from the stigma associated with hospital facilities that are directed at those who are sick and in need of treatment.

Unfortunately, the typical garments offered to women in labor, delivery, and recovery are frequently antithetical to the desires of many hospitals to instill the patients with a sense of health and wellbeing. These typical hospital garments are often called "Johnny Coats" and normally comprise thin, drafty, and revealing gowns that wrap around the patient and tie in the back. For many patients, these garments represent a loss of comfort, dignity, and control. In some cases, a loss of modesty may even cause patients to forego movement outside their hospital rooms which could be beneficial to their recovery.

For these reasons, there is an ongoing need for garments for use by female patients which are stylish, fashionable, and not highly revealing, while, at the same time, are able to fit women of many sizes. Moreover, such new garments will ideally be highly functional, giving caregivers ready access to the patient's body for necessary treatments while the patient is standing or lying, and also allowing mothers to easily breast feed their newborns.

SUMMARY OF THE INVENTION

Embodiments of the present invention address the above-identified need by providing stylish, fashionable, and not highly revealing garments for use by female patients which give caregivers ready access to the patient's body for necessary treatments while allowing the patient to easily breast feed newborns.

In accordance with an aspect of the invention, a garment comprises a frontal portion, a left rear portion, a right rear portion, a belt hole, a left belt loop, a right belt loop, a left belt, and a right belt. The frontal portion is adapted to be capable of covering at least a portion of the frontal trunk and frontal lower limbs of the female patient when the garment is worn, and defines a first portion of a left shoulder strap and a first portion of a right shoulder strap. The left rear portion is attached to a leftmost edge of the frontal portion. The left rear portion is adapted to be capable of covering at least a portion of the rear trunk and rear lower limbs of the female patient when the garment is worn, and defines a second portion of the left shoulder strap adapted to be detachably attached to the first portion of the left shoulder strap to collectively form a complete left shoulder strap. The completed left shoulder strap, in turn, is configured to be capable of passing over the left shoulder of the female patient when the garment is worn. The right rear portion is connected to a rightmost edge of the frontal portion. The right rear portion is adapted to be capable of at least partially overlapping the left rear portion when the garment is worn, and defines a second portion of the right shoulder strap adapted to be detachably attached to the first portion of the right shoulder strap to collectively form a complete right shoulder strap. Here, the completed right shoulder strap is configured to be capable of passing over the right shoulder of the female patient when the garment is worn. The belt hole is located proximate to the interface of the frontal portion and the right rear portion. Both the left belt loop and the right belt loop are attached to the frontal portion, the right belt loop being attached substantially to the right of the left belt loop. Lastly, the left belt is attached to a leftmost edge of the left rear portion and is adapted to be capable of passing through the belt hole and right belt loop when the garment is worn, and the right belt is attached to a rightmost edge of the right rear portion and is adapted to be capable of passing through the left belt loop when the garment is worn.

BRIEF DESCRIPTION OF THE DRAWINGS

These and other features, aspects, and advantages of the present invention will become better understood with regard to the following description and accompanying drawings where.

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1:
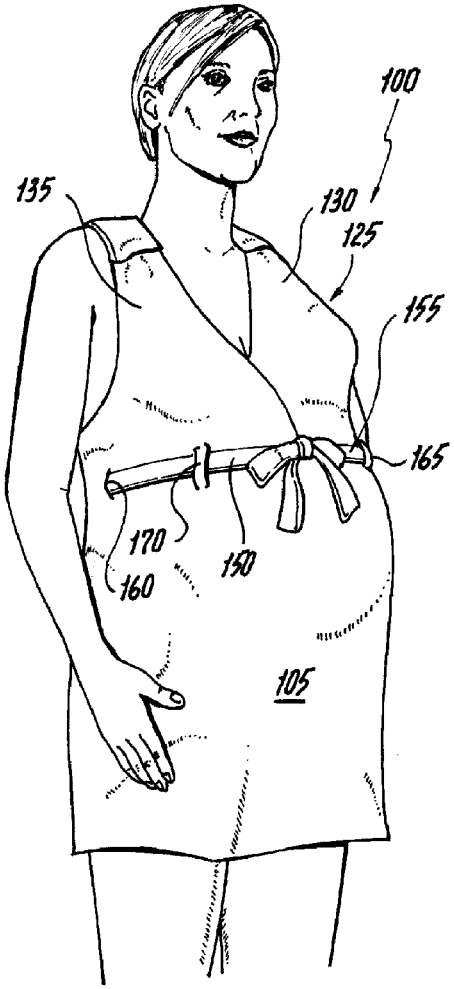
FIG. 1 shows a front perspective view of a garment in accordance with an illustrative embodiment of the invention while the garment is being worn.
Figure 2:
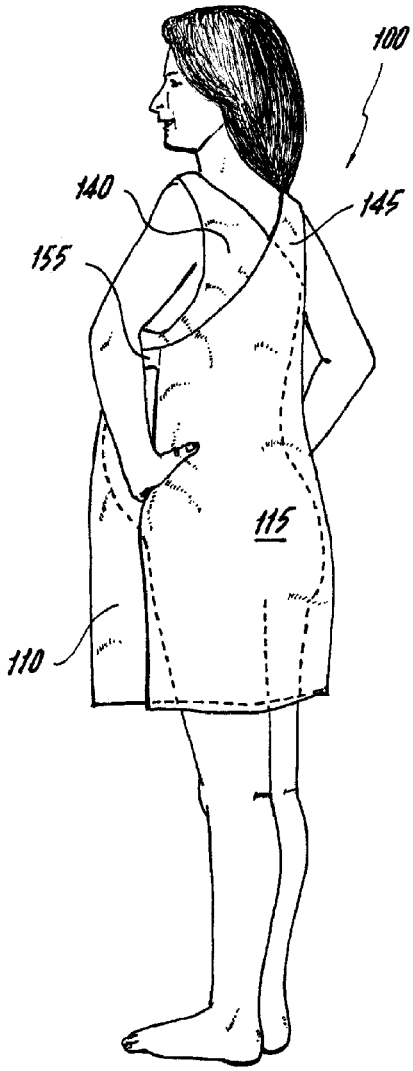
FIG. 2 shows a rear perspective view of the FIG. 1 garment while the garment is being worn.
Figure 3:
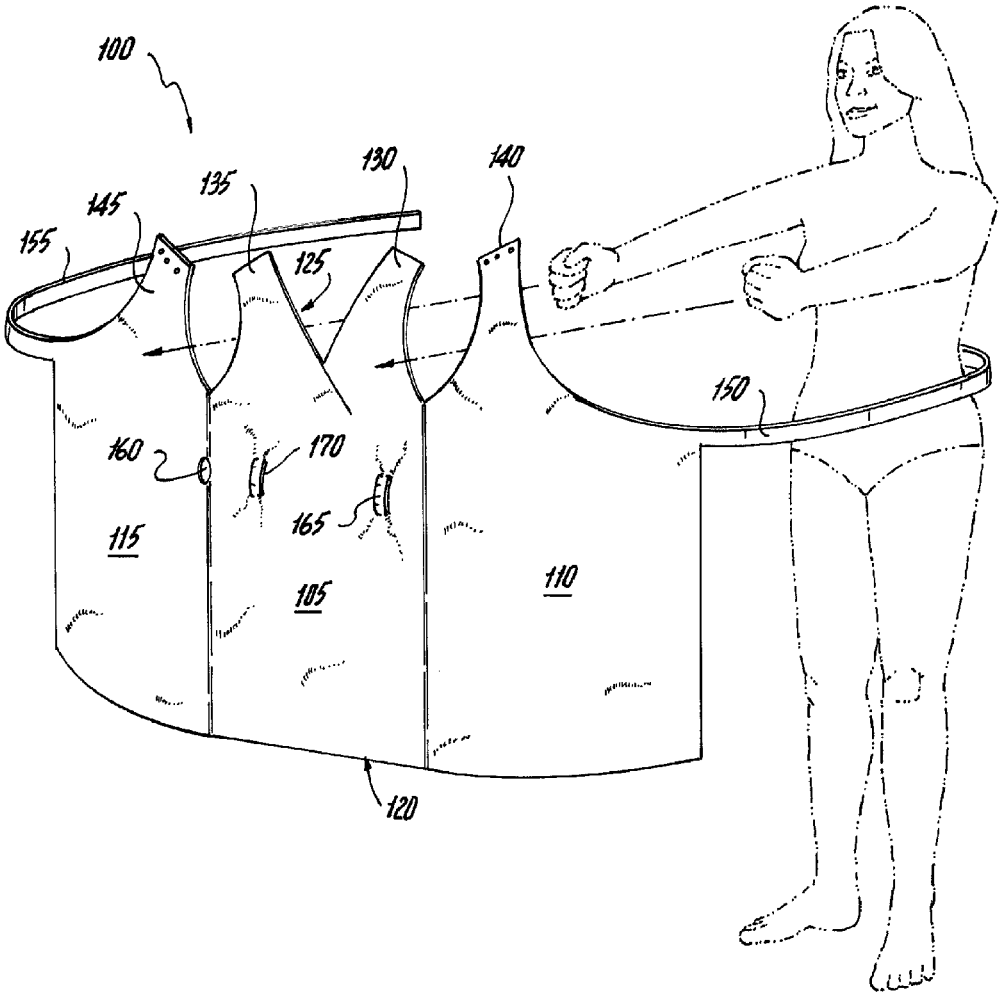
FIG. 3 shows a perspective view of the FIG. 1 garment with the garment expanded.

FIGS. 1-3 show various views of a garment 100 in accordance with an illustrative embodiment of the invention. More particularly, FIGS. 1 and 2 show perspective views of the front and rear, respectively, of the garment 100 as the garment 100 might appear while being worn. FIG. 3, in turn, shows a perspective view of the garment 100 with the garment 100 expanded.

The garment 100 can be conceptually separated into several portions, namely, a frontal portion 105, a left rear portion 110, and a right rear portion 115. Notably, the words "left" and "right" as used herein to describe aspects of the garment 100 are intended to indicate directions as determined from the perspective of a patient with the garment 100 expanded in front of the patient as though the patient were about to don the garment 100, in the manner shown in FIG. 3. Moreover, the "frontal" region of the patient, as that term is used herein, would include, for example, that patient's chest and abdomen, while the "rear" region of that patient would include that patient's back.

The frontal portion 105 is dimensioned to cover at least a portion of the frontal trunk and the frontal lower limbs of the female patient when the garment 100 is worn. The term "trunk" as used herein is intended to describe that portion of a human being from which extends the neck, upper limbs, and lower limbs. In the present exemplary configuration, the frontal portion 105 includes a lower skirt 120 that covers the female patient's abdomen, pelvis, and upper leg regions, as well as a "v-neck"-type bodice 125 that covers a portion of the patient's chest and is formed by two overlapping, somewhat triangular-shaped portions of fabric. Near the top of the frontal portion 105, two partial shoulder straps are defined: a first portion of a left shoulder strap 130 and a first portion of a right shoulder strap 135.

The left rear portion 110 is connected to the leftmost edge of the frontal portion 105. The left rear portion 110 is adapted to be capable of covering at least a portion of the rear trunk and rear lower limbs of the female patient when the garment 100 is worn. Moreover, proximate to its top, the left rear portion 110 also defines a second portion of a left shoulder strap 140. This second portion 140, in turn, is detachably attachable to the first portion of the left shoulder strap 130 defined by the frontal portion 105. When so attached, the two portions of the left shoulder strap 130, 140 collectively form a complete left shoulder strap adapted to pass over the left shoulder of the garment's wearer.

The right rear portion 115 is attached to the rightmost edge of the frontal portion 105. This right rear portion 115 is substantially a mirror image of the left rear portion 110. In a manner similar to the left rear portion 110, the right rear portion 115 defines a second portion of the right shoulder strap 145 that is detachably attachable to the first portion of the right shoulder strap 135 to form a complete right shoulder strap. Once so formed, the complete right shoulder strap may pass over the right shoulder of the female patient when she is wearing the garment 100.

A means of securing the garment 100 closed is provided by a left belt 150 and a right belt 155, as well as by a belt hole 160, a left belt loop 165, and a right belt loop 170. The left belt 150 emanates from a leftmost edge of the left rear portion 110, while the right belt 155 emanates from a rightmost edge of the right rear portion 115. The belt hole 160, in turn, is defined by the frontal portion 105 and the right rear portion 115 proximate to their interface. Finally, the left belt loop 165 and the right belt loop 170 are attached to the frontal portion 105, the right belt loop 170 being located substantially to the right of the left belt loop 165.

With these various features, the garment 100 may be secured shut by having the female patient first place her arms through the complete left and right shoulder straps so that the frontal portion 105 of the garment 100 covers her front while being supported by the patient's shoulders, and then folding the left rear portion 110 behind the female patient so that it covers her back. The left belt 150 is then fed through the belt hole 160 and the right belt loop 170 so that its distal end is now located at the front of the patient. Subsequently, the right rear portion 115 is folded over the left rear portion 110 so that it substantially overlaps the left rear portion 110 (see FIG. 2). Its right belt 155 is then fed through the left belt loop 165 so the right belt's distal end is also located proximate to the front of the patient. Once so located, the belts 150, 155 may be formed into a knot to secure the garment 100, as shown in FIG. 1. Alternatively, it has been shown that the garment 100 may be secured by simply passing the belts 150, 155 through their respective belt loops 165, 170 and allowing their distal ends to separately dangle without a knot. In this manner, less pressure is placed on the patient's abdomen, which may be more comfortable to pregnant women.

It is envisioned that a garment in accordance with aspects of the invention could be formed of many different fabrics or combinations of fabrics including, but not limited to, cotton, wool, silk, polyester, acrylic, nylon, and spandex. It is further contemplated that such garments might include additional utilitarian features such as internal liner panels and pockets, as well as additional decorative features such as logos and designs.

The exemplary garment 100 has several advantages when compared to conventional hospital gowns such as the "Johnny Coat." Firstly, the garment 100 is stylish and fashionable in the manner of wrap-type garments used outside a medical setting. Perhaps more importantly, the garment 100 is highly covering so that the wearer maintains her modesty. Lastly, the garment 100 is deliberately designed so that one size of garment can fit women of varying sizes. More particularly, a smaller woman can be accommodated by having the right rear portion 115 overlap the left rear portion 110 by a greater degree, while a larger woman can be accommodated by having the right rear portion 115 overlap the left rear portion 110 by a lesser degree.

What is more, the exemplary garment 100 is also highly functional and well suited for use during medical treatments including, but not limited to, labor, delivery, and recovery. The garment 100, for example, keeps the wearer's arms exposed so that she can easily receive an injection or intravenous fluids, or have her blood pressure monitored. The exposed arms also help to keep the wearer cool and comfortable, frequently major issues during labor. The garment 100 also helps to give caretakers easy access to various other parts of the wearer's body including her chest, abdomen, pelvis and back, even when the patient is lying prone. The wearer's abdomen and pelvis regions can, by way of example, be accessed by a caregiver by simply lifting the skirt 120 of the frontal portion 105 and allowing the left and right rear portions 110, 115 to slide apart so they overlap to a lesser degree. Likewise, her back can be accessed by simply parting the right rear portion 115 from the left rear portion 110.

Figure 4:
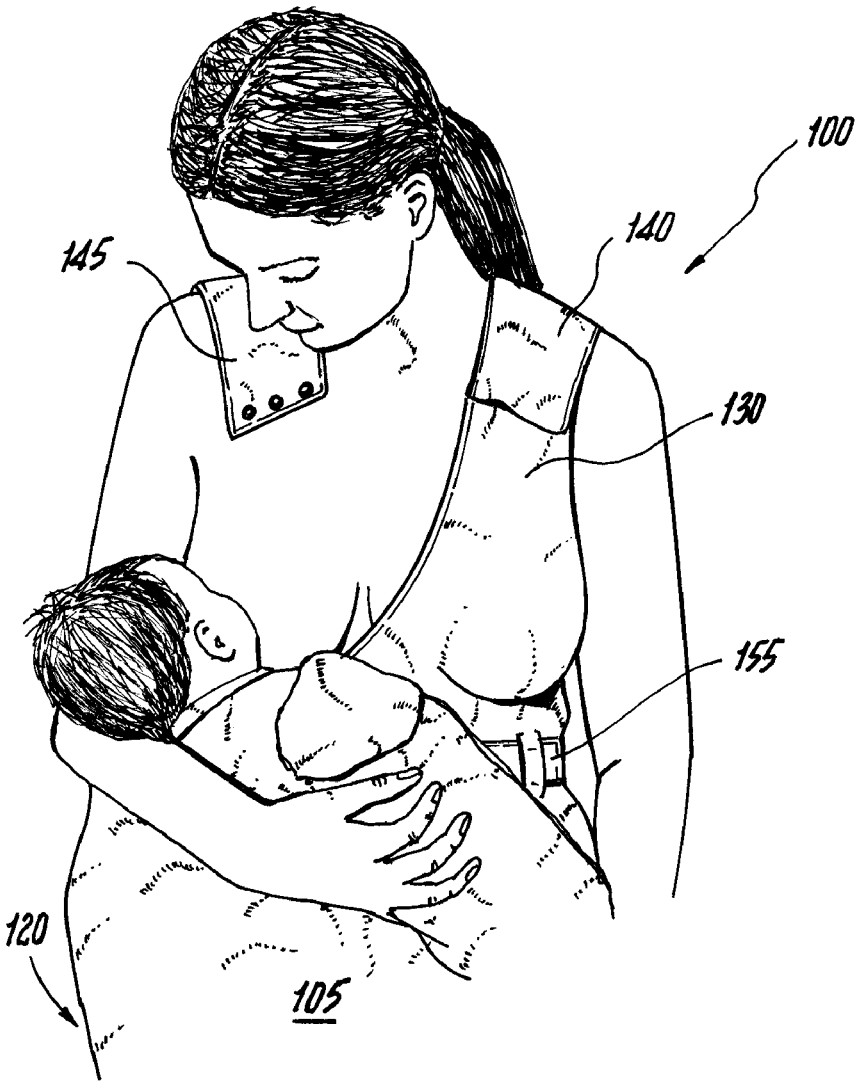
FIG. 4 shows a front perspective view of the FIG. 1 garment while the garment is being worn during breast feeding.

For accessing the female patient's breasts for examination or treatment, or alternatively, to facilitate the breastfeeding of a newborn, the detachable shoulder straps 130, 135, 140, 145 allow each breast or both to be easily exposed. To expose her right breast, for example, a wearer could simply detach the first portion of the right shoulder strap 135 from the second portion 145, and then allow the right part of the v-neck bodice 125 to drop down. Such a condition is shown in the front perspective view in FIG. 4. There are several means for allowing the first and second portions of the left and right shoulder straps 130, 135, 140, 145 to be detachably attached to one another. These means include, but are not limited to, buttons, snaps, and hook and loop fasteners in the manner of VELCRO®.

In closing, it should again be emphasized that the above-described embodiments of the invention are intended to be illustrative only. Other embodiments can use different types and arrangements of elements for implementing the described functionality. A garment, could, for example, appear very different from the exemplary one described herein and still fall within the scope of the invention. These numerous alternative embodiments will be apparent to one skilled in the art.

Moreover, all the features disclosed herein may be replaced by alternative features serving the same, equivalent, or similar purposes, unless expressly stated otherwise.

Thus, unless expressly stated otherwise, each feature disclosed is one example only of a generic series of equivalent or similar features.

What is claimed is:

1. A garment for use by a female patient, the garment comprising:

a frontal portion, the frontal portion adapted to be capable of covering at least a portion of the frontal trunk and frontal lower limbs of the female patient when the garment is worn, and defining a first portion of a left shoulder strap and a first portion of a right shoulder strap;

a left rear portion attached to a leftmost edge of the frontal portion, the left rear portion adapted to be capable of covering at least a portion of the rear trunk and rear lower limbs of the female patient when the garment is worn, and defining a second portion of the left shoulder strap adapted to be detachably attached to the first portion of the left shoulder strap to collectively form a complete left shoulder strap configured to be capable of passing over the left shoulder of the female patient when the garment is worn;

a right rear portion attached to a rightmost edge of the frontal portion, the right rear portion adapted to be capable of at least partially overlapping the left rear portion when the garment is worn, and defining a second portion of the right shoulder strap adapted to be detachably attached to the first portion of the right shoulder strap to collectively form a complete right shoulder strap configured to be capable of passing over the right shoulder of the female patient when the garment is worn;

a belt hole proximate to the interface of the frontal portion and right rear portion;

a left belt loop attached to the frontal portion;

a right belt loop attached to the frontal portion substantially to the right of the left belt loop;

a left belt attached to a leftmost edge of the left rear portion, the left belt adapted to be capable of passing through the belt hole and the right belt loop when the garment is worn; and a right belt attached to a rightmost edge of the right rear portion, the right belt adapted to be capable of passing through the left belt loop when the garment is worn.

2. The garment of claim 1, wherein the garment comprises at least one of cotton, wool, silk, polyester, acrylic, nylon, and spandex.

3. The garment of claim 1, wherein the garment is operative to fit women of substantially varying sizes.

4. The garment of claim 1, wherein the second portion of the left shoulder strap is adapted to be detachably attached to the first portion of the left shoulder strap at least in part by at least one of a button, a snap, and a hook and loop fastener.

5. The garment of claim 1, wherein the second portion of the right shoulder strap is adapted to be detachably attached to the first portion of the right shoulder strap at least in part by at least one of a button, a snap, and a hook and loop fastener.

6. The garment of claim 1, wherein the arms of the female patient are substantially exposed when the garment is worn.

7. A garment for use by a female patient, the garment comprising:

a frontal portion, the frontal portion adapted to be capable of covering at least a portion of the frontal trunk and frontal lower limbs of the female patient when the garment is worn, and defining a first portion of a right shoulder strap and a first portion of a left shoulder strap;

a right rear portion attached to a rightmost edge of the frontal portion, the right rear portion adapted to be capable of covering at least a portion of the rear trunk and rear lower limbs of the female patient when the garment is worn, and defining a second portion of the right shoulder strap adapted to be detachably attached to the first portion of the right shoulder strap to collectively form a complete right shoulder strap configured to be capable of passing over the right shoulder of the female patient when the garment is worn;

a left rear portion attached to a leftmost edge of the frontal portion, the left rear portion adapted to be capable of at least partially overlapping the right rear portion when the garment is worn, and defining a second portion of the left shoulder strap adapted to be detachably attached to the first portion of the left shoulder strap to collectively form a complete left shoulder strap configured to be capable of passing over the left shoulder of the female patient when the garment is worn;

a belt hole proximate to the interface of the frontal portion and left rear portion;

a right belt loop attached to the frontal portion;

a left belt loop attached to the frontal portion substantially to the left of the right belt loop;

a right belt attached to a rightmost edge of the right rear portion, the right belt adapted to be capable of passing through the belt hole and the left belt loop when the garment is worn; and a left belt attached to a leftmost edge of the left rear portion, the left belt adapted to be capable of passing through the right belt loop when the garment is worn.

8. The garment of claim 7, wherein the garment comprises at least one of cotton, wool, silk, polyester, acrylic, nylon, and spandex.

9. The garment of claim 7, wherein the garment is operative to fit women of substantially varying sizes.

10. The garment of claim 7, wherein the second portion of the left shoulder strap is adapted to be detachably attached to the first portion of the left shoulder strap at least in part by at least one of a button, a snap, and a hook and loop fastener.

11. The garment of claim 7, wherein the second portion of the right shoulder strap is adapted to be detachably attached to the first portion of the right shoulder strap at least in part by at least one of a button, a snap, and a hook and loop fastener.

12. The garment of claim 7, wherein the arms of the female patient are substantially exposed when the garment is worn.

* * * * *